US009764377B2

(12) United States Patent
Wolff et al.

(10) Patent No.: US 9,764,377 B2
(45) Date of Patent: Sep. 19, 2017

(54) METHOD FOR THE PRODUCTION OF CORE SAND AND/OR MOLDING SAND FOR CASTING PURPOSES

(71) Applicant: S & B Industrial Minerals GmbH, Oberhausen (DE)

(72) Inventors: Andreas Wolff, Duisburg (DE); Bettina Vennemann, Goch (DE); Dieter Genske, Olfen (DE); Peter Oberschelp, Duisburg (DE)

(73) Assignee: S & B Industrial Minerals GmbH, Oberhausen (DE)

( * ) Notice: Subject to any disclaimer, the term of this patent is extended or adjusted under 35 U.S.C. 154(b) by 0 days.

(21) Appl. No.: 15/231,403

(22) Filed: Aug. 8, 2016

(65) Prior Publication Data

US 2016/0346830 A1 Dec. 1, 2016

Related U.S. Application Data

(63) Continuation of application No. 14/653,152, filed as application No. PCT/EP2014/050055 on Jan. 3, 2014.

(30) Foreign Application Priority Data

Jan. 4, 2013 (DE) ..... 10 2013 100 060

(51) Int. Cl.

| | |
|---|---|
| ***B22C 1/18*** | (2006.01) |
| ***B22C 1/02*** | (2006.01) |
| ***B22C 1/14*** | (2006.01) |
| ***B22C 9/10*** | (2006.01) |

(52) U.S. Cl.

CPC ..... *B22C 1/14* (2013.01); *B22C 1/18* (2013.01); *B22C 1/188* (2013.01); *B22C 9/10* (2013.01)

(58) Field of Classification Search

CPC ..... B22C 1/02; B22C 1/18; B22C 1/188

USPC ..... 106/38.3; 164/528

See application file for complete search history.

(56) References Cited

U.S. PATENT DOCUMENTS

| | | | |
|---|---|---|---|
| 4,505,711 | A | 3/1985 | Lucas |
| 4,505,750 | A | 3/1985 | Cowan |
| 5,769,933 | A | 6/1998 | Landis |
| 7,479,513 | B2 | 1/2009 | Reinheimer et al. |
| 7,770,629 | B2 | 8/2010 | Weicker et al. |
| 8,029,711 | B2 | 10/2011 | Grefhorst et al. |

(Continued)

FOREIGN PATENT DOCUMENTS

| | | | |
|---|---|---|---|
| DE | 158090 | | 12/1982 |
| JP | 58/068446 | * | 4/1983 |

(Continued)

OTHER PUBLICATIONS

English translation of JP 58/068446; Apr. 1983; 5 pages.*

(Continued)

*Primary Examiner* — Helene Klemanski

(74) *Attorney, Agent, or Firm* — Finnegan, Henderson, Farabow, Garrett & Dunner LLP

(57) ABSTRACT

The invention relates to a method for producing core sand and/or molding sand for casting purposes. A granular mineral mold base material is mixed with at least one inorganic binder and additionally an inorganic expanding additive. Water glass may be used as the binder and expandable graphite may be used as the expandable additive.

13 Claims, 4 Drawing Sheets

(56) References Cited

U.S. PATENT DOCUMENTS

| | | | | |
|---|---|---|---|---|
| 2009/0025606 | A1 | 1/2009 | Grefhorst et al. | |
| 2015/0367406 | A1* | 12/2015 | Wolff | B22C 1/188 164/528 |

FOREIGN PATENT DOCUMENTS

| | | | |
|---|---|---|---|
| JP | 58/068446 | A * | 4/1983 |
| JP | 58068446 | | 4/1983 |

OTHER PUBLICATIONS

English translation of JP 58/068446, Apr. 1983; 5 pages.*
Written Opinion of the International Searching Authority of PCT/EP2014/050055; Jul. 7, 2015; 5 pages.
Derwent Abstract of DD 158090; Dec. 1982.
"Foundry Handbook, vol. 5, Foundry Technology (2nd Edition)", Foundry Institution of Chinese Mechanical Engineering Society, pp. 45-46, China Machine Press, Jan. 31, 2003.

* cited by examiner left = Sample No. 1 right = Sample No. 2

METHOD FOR THE PRODUCTION OF CORE SAND AND/OR MOLDING SAND FOR CASTING PURPOSES

CROSS REFERENCE TO RELATED APPLICATIONS

This is a continuation of application Ser. No. 14/653,152, filed Jun. 17, 2015, which is a U.S. national stage of PCT application PCT/EP2014/050055 filed Jan. 3, 2014, which claims the priority of German patent application 102013100060.6, filed Jan. 4, 2013, all of which are incorporated here by reference.

FIELD

The invention relates to a method of making core sand and/or molding sand for foundry use, where a granular, mineral and refractory mold base material is mixed with at least one inorganic binder and also with an inorganic expandable additive

BACKGROUND

Bentonite is typically used as the binder in a method of the type described above, such as EP 2 014 391 [U.S. Pat. No. 8,029,711] by the instant patent applicant, for example, or U.S. Pat. No. 4,505,750. The expandable additive, which is added, may be perlite, vermiculite or expandable graphite. The expandable additive has an expanding index of at least 9, i.e. the expandable additive in question multiplies its volume accordingly at a certain temperature. This temperature is typically 300° C. This prevents harmful emissions in particular and improves the quality of the casting.

Inorganic binders such as bentonite according to EP 2 014 391 have the fundamental advantage in comparison with organic binders that they release significantly fewer pollutants during casting. In addition to bentonite as an inorganic binder for molds and cores, molding material mixtures may basically be used to make metal-processing casting molds that rely on a water glass-based binder as described in DE 10 2004 042 535 [U.S. Pat. No. 7,770,629].

In general, the individual grains of the granular, mineral and refractory mold base material are bonded and/or glued to one another with the help of the inorganic binder. The mold base material is typically sand and/or quartz sand. The physical curing of the binder from water glass, for example, usually takes place by heating, namely by extracting moisture by drying. The drying may take place in a hot core box, by gassing with hot air in the respective core box or with the help of microwave heating and/or in a traditional furnace.

After curing, the grains of the mold base material are bonded together by binder bridges created with the help of the binder. The additional expandable additives added within the scope of EP 2 014 391 or according to U.S. Pat. No. 4,505,750 ensure that removal of the core is facilitated because the expandable additive ensures that the core can be separated from the casting, for example.

Problems can often occur at this point because of the special characteristics of the inorganic binder and in particular the water-glass binders, so that separation of the core and/or core sand and/or mold sand from the cast part is incomplete or only partially successfully. For example, DD 158 090 relates to a method for regulating the strength of inorganic molding materials based on alkali silicate solutions. The special characteristics of water glass as a binder are described here and the unsatisfactory disintegration properties are also presented in this context.

These disintegration properties must now be mapped in the most accurate and error-free manner possible. Surface defects, for example, may occur when particles and/or grains become detached. Furthermore, single-phase or multiphase inclusions that may be observed at the surface of the casting can be attributed to reactions of the core sand and/or mold sand with the melt. Such inclusions are sometimes macroscopic, i.e. visible to the naked eye, and usually affect the mechanical properties of a casting. In an extreme case, this may result in rejects.

In production of the cast parts, the focus not just on a satisfactory cast surface but instead the entire manufacturing process makes particularly high demands of core removal. In other words, after the casting has been produced, it is important for the molds and cores to be separated satisfactorily from the casting. To support this process mechanical energy is often applied by shaking or vibrating that, in addition to the expandable additive, ensures that the binder bridges between the individual grains are destroyed and consequently, in the ideal case, the mold base material trickles out of the casting freely.

In particular in the case of cores with inorganic binders and having narrow dimensions in the millimeter range, such as those observed in particular with cylinder heads having a water jacket for production of automotive engines, core-removal problems occur and may be further exacerbated by the relatively low casting temperatures of the aluminum alloys that are generally used here. In other words, with the thin passages that are formed, core sand residues may often remain adhering in or may even block the passages. In addition, inorganic binders based on bentonite are generally associated with the disadvantage that the casting molds produced from them have a relatively low strength. However, a high strength is especially important when making such complicated thin-walled cores (molds) and for their safe handling.

The reason for the low strength of bentonite-bonded molds and cores in comparison with molds and cores bonded with water glass, for example, can be attributed essentially to the fact that the bentonite-bonded casting molds have a slightly different binding mechanism and still contain residual water from the binder. This is where the invention begins.

OBJECT OF THE INVENTION

The object of the invention is to refine a method of the type described above so that a satisfactory and rapid disintegration of the casting mold produces a satisfactory surface on the casting.

SUMMARY

To attain this object, a generic method within the context of the present invention is characterized in that water glass is used as the binder and expandable graphite is used as the expandable additive Within the framework of the invention, water glass is used first as the binder. Water glass is known to comprise vitreous water-soluble sodium and potassium silicates that have solidified from a melt or their aqueous solutions. Depending on whether primarily sodium or potassium silicates are present, we speak of sodium water glass or potassium water glass. Such water glasses are characterized by a high rate of binding and low emissions. Use of water glass in casting technology for curing molds and cores is basically known, as shown in DE 10 2004 042 535, for example, although not in combination with an additional expandable additive in the form of expandable graphite.

Expandable graphites are in fact special graphites that typically expand by approximately 50% to 600% by volume when heated to temperatures above 150° C. The aforementioned expansion can be determined, for example, so that the expandable graphite in question is optionally ground and then heated in a melting crucible. By comparing the volume before and after heating, it is possible to infer the increase in volume. A certain amount of expandable graphite (in grams) is usually used in this process, so that not only can the increase in volume be given but also there is an expansion rate, i.e. the increase in volume (in $cm^3$) per gram of expandable graphite used.

Details about the production of such expandable graphite, as well as the measurement of the expansion properties, can be obtained from EP 1 489 136, among others. According to this, the expansion properties of expandable graphite can be determined with the help of thermomechanical analysis (TMA), for example.

With the help of this thermochemical analysis, changes in the dimensions of the expandable graphite and/or individual graphite particles are measured as functions of temperature and time. For this purpose, the sample of the expandable graphite is applied to a sample support, and the changes in dimension of the sample are measured and recorded with the help of a measurement probe as a function of the heating temperature and the heating time. To do so, the powdered sample of expandable graphite can typically be placed in a corundum crucible that is covered with a steel crucible. The steel crucible ensures a smooth transfer of the changes in dimension of the sample during expansion of the sample to the measurement probe that is in mechanical contact with the top side of the steel crucible. Furthermore, the measurement probe is exposed to an adjustable applied load.

Additional details of this thermochemical analysis (TMA) and the calculation of the expansion of the substance in % and/or in $cm^3$ are described in detail in EP 1 489 136 [U.S. Pat. No. 7,479,513] already cited above. As a result of this, the expandable graphite can be characterized on the basis of its expansion rate, i.e. the increase in volume (in $cm^3$) based on the weight (in g) among others.

The expandability of the expandable graphite can be attributed to the fact that foreign constituents are incorporated between the lattice planes of the graphite and cause widening of the interlattice spaces when there is an input of energy. These foreign constituents may be metallic groups, halogens, OH groups, acid residues or even $SO_x$ and/or $NO_x$.

Within the context of this invention, expandable graphites that expand only weakly may be used in particular. On the one hand, these greatly improve core removal, while on the other hand, the surface of the cast part formed after casting shows practically no negative influences.

DETAILED DESCRIPTION

To demonstrate this situation quantitatively in particular, casting experiments were performed in this context using water-glass-bonded test bodies and additives of expandable graphites with different expansion rates.

To do so, a granular, mineral mold base material (quartz sand) with water glass as the binder, with 1.6% by weight and 0.3% by weight expandable graphite, each based on the mold base material with two different expansion rates were used for the casting experiment:

1. Expansion rate <120 $cm^3/g$ (expandable graphite) sample 1
2. Expansion rate >350 $cm^3/g$ (expandable graphite) sample 2

In the remaining course of the experiment, the moldings were introduced as inner cores into a shared mold and then cast. After cooling, a simple core removal was apparent with both, i.e. the quartz sand could be seen to simply trickle out of the cast body. However, when the two cast bodies were cut open, it was also apparent that the expandable graphite with the high expansion rate (>350 $cm^3/g$) had such a great influence on the formation of the cast surface of the sample body (cf. FIG. 4, sample 2) that, as a result, residues of the expandable graphite were macroscopically discernible on the cast surface.

Figure 4:
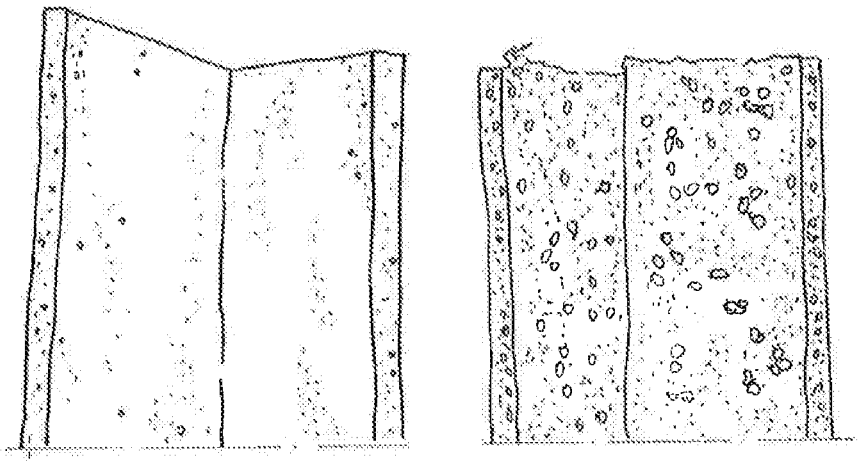
FIG. 4 shows two samples side by side.

In comparison with sample body 1 and/or sample 1 in FIG. 4, which had been treated with expandable graphite that would expand only weakly, these strong influences on the surface were visible very little or not at all, so that very few or no restrictions could be ascertained with regard to the surface quality in the casting experiment.

Thus, from the casting experiments described above, an expandable graphite with an expansion rate of more than 10 $cm^3/g$, in particular an expandable graphite with an expansion rate of 10 to 100 $cm^3/g$, max. 120 $cm^3/g$, proved to be particularly favorable. The lower limit of 10 $cm^3/g$ is explained by the fact that core removal is possible only at such an expansion rate of the expandable graphite, i.e. the mold disintegrates satisfactorily without any residues adhering to the cast body. In principle, it is also possible to work with an expansion rate of more than 350 $cm^3/g$. However, reduced surface quality is to be expected here, as already described in the casting experiment.

In general, expansion rates up to max 350 $cm^3/g$ and in particular up to 100 $cm^3/g$ are thus especially preferred. The expansion rate indicates the increase in volume of the expandable graphite (in $cm^3/g$), based on its weight (in g).

In production of the expandable graphite according to the invention, sulfur or nitrogen compounds are generally also incorporated into the individual layers of the graphite. Consequently, these are $SO_x$ or $NO_x$ expandable graphites that typically have a starting temperature >180° C. for expansion. A starting temperature of approximately 220° C. in particular is observed. This means that the increase in volume described above is observed only above the indicated temperatures (>180° C.).

Typically the material used as expandable graphite is one in which the particle size is more than 20 μm. In particular particles, i.e. grains in a diameter range from 20 μm to 150 μm, are used and those with a grain size between 150 μm and 300 μm are preferred.

The grain size of the expandable graphite up to max. 300 μm as described here takes into account, among other things, that granular mineral sand, such as quartz sand in particular, is generally used as the mold base material. This quartz sand is usually available in an average grain size of <0.5 mm, i.e. typically with a grain diameter of <500 μm. In general, its grain size will be in the range between 100 μm and 300 μm. Therefore, the grains of the expandable graphite, on the one hand, and the mold base material, on the other hand, are of approximately the same dimensions that facilitates the mixing of the mold base material with the expandable graphite and its uniform distribution within the core sand and/or mold sand thus produced.

The expandable graphite generally has a carbon content of 85% by weight to 99.5% by weight. The maximum moisture content of the expandable graphite is in the range of max. 1% by weight. The pH may be between 3 and 8. The starting temperature is in the range between 180° C. and 220° C.

In most cases, the expandable graphite is added to the mixture in an amount of up to approximately 1% by weight and preferably up to approximately 0.5% by weight. The mixture is preferably a mixture of granular, mineral mold base material and at least one inorganic binder. According to the invention, the inorganic expandable additive in the form of the expandable graphite is added to this mixture. An expandable graphite content of approximately 0.1% by weight in the mixture in question is especially preferred. The amounts in wt % (percent by weight) relate to the mold base material used.

Nevertheless, the expandable graphite constituents that are introduced into the mixture and are distributed uniformly, based on the adaptation of the respective grain diameter of the mold base material, on the one hand, and the expandable graphite, on the other hand, are enough to simplify the core removal beyond the starting temperature. Practically all bonds between individual grains of the mold base material are broken by the expandable graphite introduced.

At the same time, the expandable graphite with its relatively low expansion rate of typically no more than 100 $cm^3/g$ and/or no more than 350 $cm^3/g$ ensures that the surface of the cast part thus formed is not affected negatively or is practically not affected at all. This can be attributed essentially to the fact that, on the one hand, the weak expansion of the expandable graphite does not act excessively upon the grains of the mold base material with a pressure that is built up from the inside, but instead the moderate expansion rate leads mainly to the result that the binder bridges are ruptured. On the other hand, the expandable graphite added as the expandable additive is present in a particularly fine distribution, so that in principle there cannot be any inclusions at the surface of the casting or practically none at all.

It is also particularly important that high bending strengths that are much higher than 100 $N/cm^2$ are observed, so consequently, the dry compressive strength values reported in EP 2 014 391 in the range of approximately 40 $N/cm^2$ greatly exceed those. This is because bending bars can be produced for determining the bending strength cited previously in general by the method according to the invention, whereas such bending bars cannot be produced at all by the method according to EP 2 014 391. At any rate, the strength is greatly increased in comparison with the teaching according to EP 2 014 391.

The comparative test values for the bending strength of bentonite-bonded and water-glass-bonded test bodies shown in Table 1 mainly support this representation of the facts of the case. The bentonite-bonded test body corresponds to the prior art as described in EP 2 014 391, and bentonite is used as the inorganic binder. On the other hand, the water-glass-bonded test body belongs to the method according to the invention, in which water glass (in combination with expandable graphite as an expandable additive) is used as the binde.

Bentonite (5% by weight based on the quartz sand)+water+quartz sand were used as the bentonite-bonded molding material. Furthermore, the bentonite-bonded molding material contains 0.3% by weight expandable graphite (based on the quartz sand) with an expansion rate of <100 $cm^3/g$. The entire production of the test bodies took place in a laboratory grinding mill and in accordance with VDG Memorandum P 69 on production of test bodie.

For comparison purposes, the water-glass-bonded molding material in the method according to the invention consisted of 1.6% by weight water glass (based on the quartz sand and/or the granular mineral mold base material) as well as the same amount of expandable graphite as that used previously, with the remainder being quartz sand. The test body was produced here in a blade mixer and the water-glass-bonded cores were cured in a drying cabinet.

The following bending strength values were obtained by testing the bentonite-bonded and water-glass-bonded test bodies. These results show the great differences that were already known, with regard to the bending strength, in particular the practically immeasurable bending strength values of bentonite-bonded molding materials (measurements 1 to 3 each relate to three test bodies of the same grammage and production that were tested for statistical purposes):

TABLE 1

Measurement series for testing bentonite-bonded test bodies and water-glass-bonded test bodies

| Measurement | Bending strength of bentonite-bonded test | Bending strength of water-glass-bonded test bodies |
|---|---|---|
| 1 | less than 20 $N/cm^2$ | 350 $N/cm^2$ |
| 2 | less than 20 $N/cm^2$ | 360 $N/cm^2$ |
| 3 | less than 20 $N/cm^2$ | 350 $N/cm^2$ |

The use of a bentonite-bonded molding material is thus limited to molds that are generally used only to form the exterior contour of casting molds that is a disadvantage on the whole because it is practically impossible to produce inner cores and/or inner contours, for example, in this way.

In addition, there is the fact that for possible stabilization and to form the required strength values, such bentonite-bonded molding materials must always be in a mold frame, also known as a so-called a mold box that compensates for this strength disadvantage of the binder.

This can also be regarded as an additional disadvantage, because, first of all, there are additional costs of materials here for the mold boxes and, secondly, the mold boxes must be cleaned and/or reprocessed after each respective use, but this also generates additional costs.

For comparison purposes, water-glass-bonded moldings and/or molding materials can be produced without using stabilizing mold frames (mold boxes), so that they can be handled freely and inexpensively and thus also can be used for a wider range of applications than bentonite-bonded moldings with regard to their use in foundry technology. In particular the production of cores for the formation of internal contours, for example, water jacket cores for use in the production of casting molds for water-cooled engines, can be mentioned here, where it is impossible to map and handle the latter using bentonite-bonded cores. This is where the essential advantages can be seen.

The core sand and/or mold sand produced by the method according to the invention may also be used advantageously for production of casting molds for iron-carbon alloys, aluminum alloys, copper alloys, such as brass, bronze, etc., but also for magnesium alloys and the cast parts produced from them. The casting molds in question are typically used in the automobile industry. In fact, this makes it possible to make casting molds that have particularly fine filigree structure with thin contours and in particular core contours in the range of only a few millimeters. Such narrow contours and in particular passages for cooling water in the production of cylinder heads can be implemented in a particularly advantageous manner with the help of casting molds that have been produced on the basis of the core sand and/or mold sand being produced according to the invention. The essential advantages of the teaching according to the invention can be seen herein.

COMPARATIVE EXAMPLE 1

Figure 1:
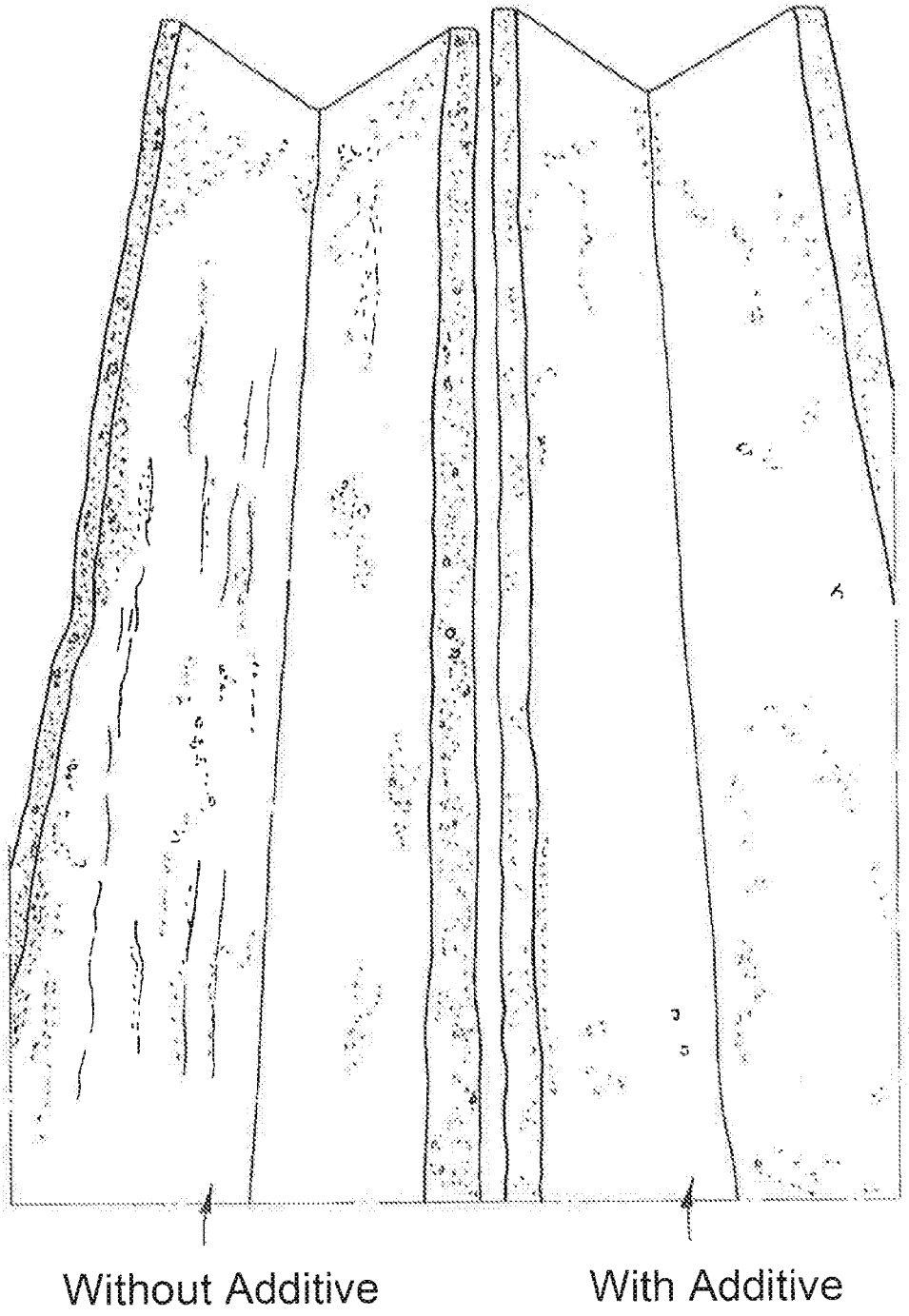
FIG. 1 is a side-by-side view of two castings, one without the additive of this invention, the other with the additive.

The photograph in FIG. 1 shows a cast piece in the left photo that was produced by relying on a core sand and/or mold sand as well as water class as the binder without using expandable graphite. The photograph on the right in FIG. 1 shows the respective workpiece with added expandable graphite in an amount of 0.1% by weight, based on the core sand and/or mold sand produced (also using water glass as the binder, and with the same grammage used in both cases for water glass and the core sand or mold sand as well as using the same core sand or mold sand).

It is clear on the basis of the photographs in FIG. 1 that the cast surface is significantly improved by adding expandable graphite itself in the amount indicated, as shown by the photograph on the right in FIG. 1. On the other hand, definite defects at the cast surface can be expected if expandable graphite is omitted, as illustrated by the photograph on the left in FIG. 1.

THEORETICAL CONSIDERATIONS

Figure 2:
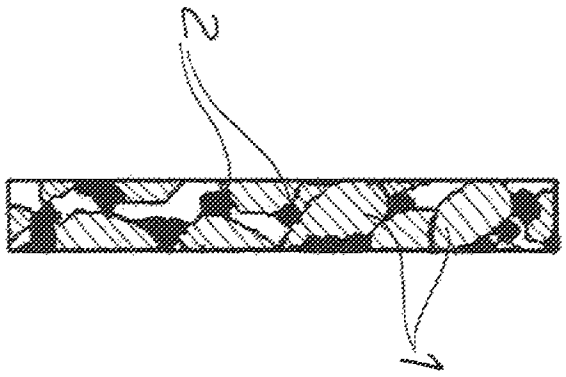
FIG. 2 is a large-scale view of part of a mold made according to the invention.
Figure 3A:
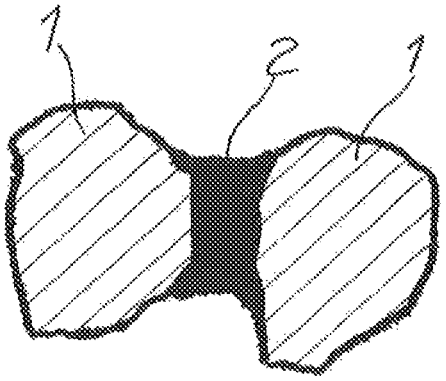
FIG. 3A is a large scale view illustrating the bond of this invention between two grains of sand as it is heated.
Figure 3B:
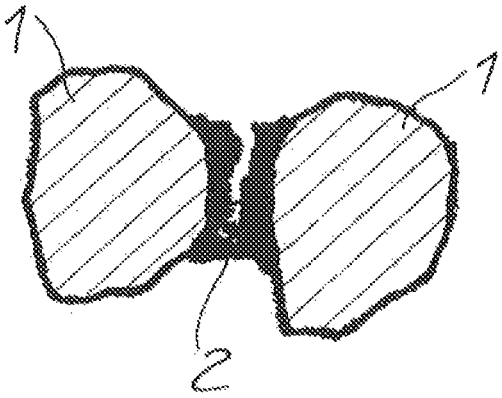
FIG. 3B is a large scale view illustrating the bond of this invention between two grains of sand as it is heated.
Figure 3C:
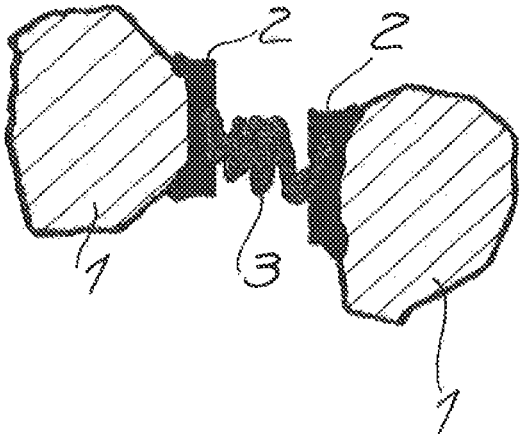
FIG. 3C is a large scale view illustrating the bond of this invention between two grains of sand as it is heated.

FIGS. 2 and 3A through 3C show the basic process in the production of a mold with the help of the core sand and/or mold sand according to the invention. FIG. 2 shows how the sand grains 1, which are predominantly shown hatched, together with inorganic binder and/or water glass 2, shown in black, can fill out a water jacket core of a corresponding core mold. FIG. 3A, for example, shows two grains, i.e. grains of sand 1, of the mold base material linked together by a bridge that is shown in black and is made of the inorganic binder and/or water glass 2. FIG. 3B shows how, when the starting temperature is exceeded, a crack is formed in the bridge between the sand grains 1 formed due to the inorganic binder and/or the water glass 2. Essentially the expandable graphite, which expands at a temperature above the starting temperature, is responsible for this. Finally, FIG. 3C shows the break produced in this way in the binder bridge 3 created by the binder and/or water glass 2.

What is claimed is:

1. A method of making a core sand and/or mold sand for foundry use, comprising mixing a granular, mineral mold base material with at least one inorganic binder and an inorganic expanding additive, wherein water glass is utilized as the binder and expandable graphite is utilized as the expanding additive, and wherein the expandable graphite is added to the mixture of mold base material and water lass in an amount of up to approximately 0.5% by weight, based on the mold base material.

2. The method according to claim 1, wherein the expandable graphite has an expansion of up to approximately 350 cm3/g.

3. The method according to claim 1, wherein the starting temperature for expansion of the expandable graphite is higher than 180° C.

4. The method according to claim 1, wherein the starting temperature for expansion of the expandable graphite is in the range between approximately 180° C. and 220° C.

5. The method according to claim 1, wherein the expandable graphite is added in a particle size of more than 20 μm.

6. The method according to claim 1, wherein is added in a particle size in the range of 20 to 150 μm.

7. The method according to claim 1, wherein the expandable graphite has a carbon content of 85% by weight to 99.5% by weight.

8. The method according to claim 1, wherein the expandable graphite is added to the mixture of mold base material and water glass in an amount of up to approximately 0.1% by weight, based on the mold base material.

9. The method according to claim 1, wherein the expandable graphite is added to the water glass and then mixed with the mold base material or is added as a separate additive to the mold base material and including the water glass.

10. A method of casting, comprising:

mixing a granular, mineral mold base material with at least one inorganic binder and an inorganic expanding additive;

forming a casting mold from the resulting mixture; and casting a metal alloy in the casting mold, wherein water glass is utilized as the binder and expandable graphite is utilized as the expanding additive; and wherein the expandable graphite is added to the mixture of mold base material and, water class in an amount of up to approximately 0.5% by weight, based on the mold base material.

11. The method of claim 10, wherein the metal alloy is an aluminum alloy, iron carbon alloy, copper alloy and/or a magnesium alloy.

12. The method of claim 10, wherein the casting mold is utilized in the automobile industry.

13. The method according to claim 1, wherein the expandable graphite has an expansion of 10 to 100 cm3/g.

* * * * *